US005513664A

United States Patent [19]

Krupsky

[11] Patent Number: 5,513,664

[45] Date of Patent: May 7, 1996

[54] METHOD OF CONSTRUCTING ARTIFICIAL FINGER NAILS

[76] Inventor: Gina Krupsky, 12 Hawkweed La., Madison, Wis. 53719

[21] Appl. No.: 290,215

[22] Filed: Aug. 15, 1994

[51] Int. Cl.[6] ..... A45D 31/00

[52] U.S. Cl. ..... 132/200; 132/73

[58] Field of Search ..... 132/73, 200

[56] References Cited

U.S. PATENT DOCUMENTS

| | | | |
|---|---|---|---|
| 3,461,885 | 8/1969 | Coveney | 132/88.5 |
| 3,750,684 | 8/1973 | Russell | 132/73 |
| 3,967,631 | 7/1976 | Kosai | 132/73 |
| 4,007,748 | 2/1977 | Matranga et al. | 132/73 |
| 4,135,526 | 1/1979 | Matranga et al. | 132/73 |
| 4,157,095 | 6/1979 | Sweet | 132/73 |
| 4,299,243 | 11/1981 | Umstattd | 132/73 |
| 4,346,720 | 8/1982 | Hokama | 132/73 |
| 4,361,160 | 11/1982 | Bryce | 132/73 |
| 4,408,622 | 10/1983 | Meyerhoefer | 132/73 |
| 4,450,848 | 5/1984 | Ferriano | 132/73 |
| 4,554,935 | 11/1985 | Hokama | 132/73 |
| 4,605,024 | 8/1986 | Tremblay | 132/88.5 |
| 4,625,740 | 12/1986 | Roth | 132/73 |
| 4,627,453 | 12/1986 | Isler | 132/73 |
| 4,632,134 | 12/1986 | Reid | 132/73 |
| 4,718,957 | 1/1988 | Sensenbrenner | 156/152 |
| 4,745,934 | 5/1988 | Mastet al. | 132/73 |
| 4,751,935 | 6/1988 | Mast et al. | 132/73 |
| 4,779,632 | 10/1988 | Howa | 132/200 |
| 4,860,774 | 8/1989 | Becker | 132/200 |
| 5,127,414 | 7/1992 | Mast et al. | 132/73.5 |

FOREIGN PATENT DOCUMENTS

| | | | |
|---|---|---|---|
| 167329 | 1/1986 | European Pat. Off. | 132/73 |

*Primary Examiner*—John G. Weiss
*Attorney, Agent, or Firm*—DeWitt Ross & Stevens

[57] ABSTRACT

An improved method of constructing an artificial fingernail is provided. A commonly available non-cutaway nail extention tip or product of similar design is filed to match a wearer's cuticle and then fastened to the entire exposed portion of a person's natural fingernail using a combination of regular nail glue and gelatinous form-adaptive nail glue.

19 Claims, 5 Drawing Sheets

METHOD OF CONSTRUCTING ARTIFICIAL FINGER NAILS

FIELD OF INVENTION

This invention relates to the construction of an artificial fingernail which lengthens, reinforces, and enhances the appearance of the wearer's natural fingernail.

DESCRIPTION OF PRIOR ART

The prevailing methods of constructing artificial fingernails can be grouped into two basic procedures. The first involves the application of a preformed plastic nail covering. These plastic nails are typically attached to the entire exposed portion of the natural nail using either a water soluble type adhesive or a cyanoacrylate based adhesive. These have also been applied using double-sided sticky tabs similar to carpet tape. The problems inherent in this method are as follows:

1. Adhesion of said preformed plastic nail coverings has been unreliable due to the disparate contours of the artificial and natural nails. A perfect fit is difficult to achieve. Consequently, it is widely recommended that these nail extensions be worn for no more than twenty-four hours at a time.

2. The thickness of said preformed plastic nail coverings has been uniform throughout the entire shell resulting in an unnaturally thick appearance in the area adjacent to the cuticle of the wearers fingernail.

Another prior method of artificial nail construction involves the use of commercially available cutaway nail tips (shown at 20 in FIG. 1) and non-cutaway nail tips (shown at 30 in FIG. 2). A characteristic trait of the non-cutaway nail tip is its thinness at the cuticle end relative to the rest of the nail tip. Non-cutaway nail tips are commonly available at beauty supply stores and have been exclusively used in the following manner: The non-cutaway plastic nail tip is glued onto the free edge 32 of a client's natural fingernail 34. The raised seam of the area of adhesion is then filed so that the surface of the natural nail is flush and contiguous with the surface of the artificial tip. This entire contiguous surface is then typically covered with a coating 36 of liquid acrylic, porcelain, fiberglass, or similar product, creating a rigid shell of protection. The shell created by the applied substance can then be filed and buffed until it resembles a healthy and natural looking fingernail. FIGS. 2–4 show the conventional application of a non-cutaway professional nail tip. Use of the plastic nail tips is optional. The acrylic, porcelain or similar product can also be applied without using the plastic nail tips. The problems inherent in these methods are as follows:

1. The process of blending the attached tip into the natural nail requires removing much of the natural nail, thus thinning and weakening it.

2. The use of fiberglass and acrylic products results in relatively prolonged exposure to unpleasant chemical odors.

3. The amount of filing and buffing required to finish the applied hardened shell of material exposes the operator and client to the inhalation of a considerable amount of airborne filings.

4. The typical maintenance of such services consists of filling in the area of growth (adjacent to the cuticle) with new product, then smoothing and filing. Thus, for extended periods of time, the physical condition of the covered natural nail cannot be ascertained. Conditions such as fungus infections cannot be identified until they are far progressed.

5. Rigid, brittle substances such as acrylic and porcelain and layered substances such as fiberglass often chip, crack and peel resulting in premature deterioration of the applied nails.

SUMMARY OF THE INVENTION

The present invention relates to a method for applying an artificial nail tip to a wearer's fingernail comprising the steps of selecting an artificial nail tip sized to fit over the wearer's fingernail, the nail tip having a cuticle end and an underside contact area; shaping the cuticle end of the nail tip to conform to the cuticle area of the wearer's fingernail; applying a small portion of regular liquid nail glue to the underside contact area of the nail tip; applying a generous portion of gelatinous nail glue to the wearer's fingernail; pressing the cuticle end of the nail tip against the cuticle of the wearer's fingernail; pivoting the nail tip downward until the nail tip is seated over the fingernail; and applying pressure to the nail tip and allowing sufficient time for bonding of the nail tip to the fingernail.

The present invention additionally relates to a method for applying an artificial nail tip to a wearer's fingernail comprising the steps of: selecting an artificial nail tip sized to fit over the wearer's fingernail, the nail tip having a cuticle end and an underside contact area; applying a generous portion of gelatinous nail glue to the wearer's fingernail; and seating the underside contact area of the nail tip atop the gelatinous nail glue to thereby bond it to the wearer's fingernail.

The present invention also relates to a method for applying an artificial nail tip to a wearer's fingernail comprising the steps of: selecting an artificial nail tip sized to fit over the wearer's fingernail, the nail tip having a thinned cuticle end and an underside contact area; shaping the thinned cuticle end of the nail tip to conform to the cuticle area of the wearer's fingernail; etching the wearer's fingernail; applying a generous portion of gelatinous nail glue to the wearer's fingernail; applying a small portion of regular liquid nail glue to the underside contact area of the nail tip; pressing the thinned cuticle end of the nail tip against the cuticle of the wearer's fingernail; pivoting the nail tip downward until the nail tip is seated over the fingernail; applying pressure to the nail tip and allowing sufficient time for bonding of the nail tip to the fingernail; and shaping the nail tip.

The present invention improves upon the above processes in the following ways:

1. It uses, in conjunction with regular cyanoacrylate nail glue, cyanoacrylate glue in a much thicker, gelatinous form. This creates a perfectly conforming adhesive layer between the natural nail and the applied nail covering which eliminates all air pockets and insures a perfect fit. The problem of disparate surface contours is thus eliminated and a much longer wearing period is made possible.

2. The unnatural looking thickness of said preformed plastic nail coverings is avoided in the present invention through the unconventional use of the non-cutaway nail tips commonly available in beauty supply stores. Non-cutaway nail tips have exclusively been applied in the manner illustrated in FIGS. 2–4. The present invention requires using said non-cutaway nail tips in an unconventional manner, covering the entire exposed top surface of the natural nail, as illustrated in FIG. 5. The characteristic thinness of said non-cutaway nail tip at the cuticle end is critical to the attainment of a natural-looking finished product, when applied according to the present invention.

3. It requires only that the surface of the nail be lightly etched for the purpose of removing excess oils present on the surface of the nail. No blending or deep filing is necessary. Damage to the natural nail is minimized.

4. It eliminates the exposure to acrylic odors and airborne particles.

5. It provides a biweekly maintenance procedure in which the artificial nails are completely removed. The natural nails can then be thoroughly inspected and cleansed before a new set is applied.

6. Its one-piece preformed and relatively flexible design eliminates chipping, cracking and peeling.

7. It provides for completion of the services in less time and with less expense than the aforementioned methods.

DESCRIPTION OF THE PREFERRED EMBODIMENT

Initially, the wearer's hands should be cleansed with disinfectant type soap or detergent. The cuticles 42 of the nails 40 should be rolled back and removed, and then cleansed with quick evaporating antiseptic or 70% isopropyl alcohol.

Figure 1:
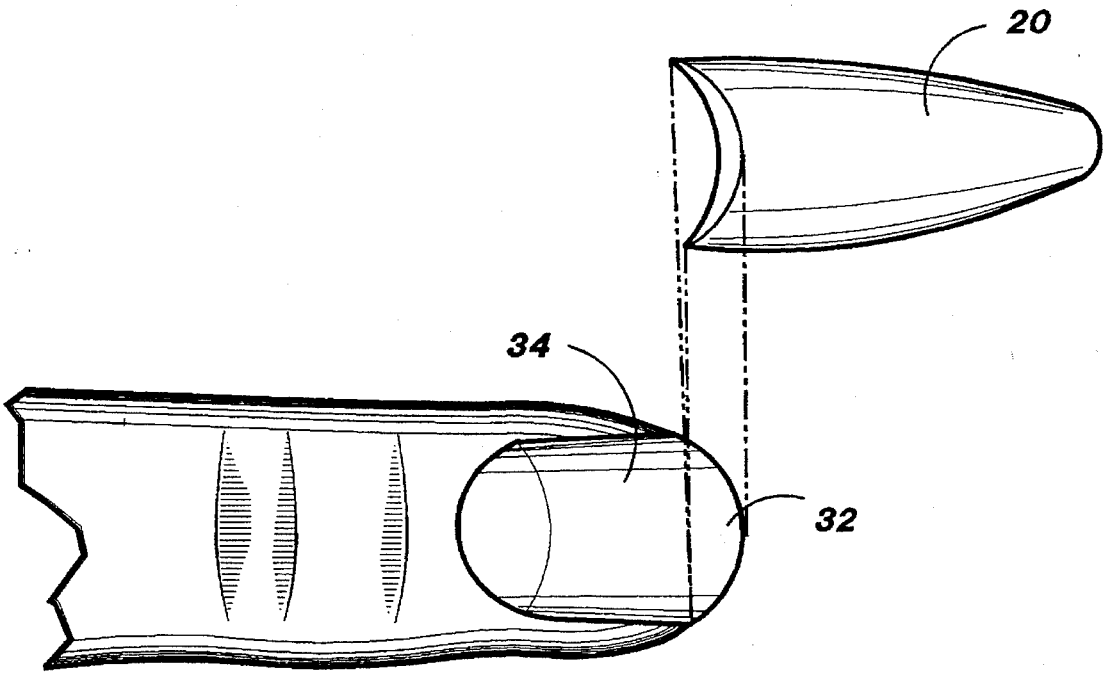
FIG. 1 (PRIOR ART)
FIG. 1 illustrates the placement of a cutaway nail of the prior art in relation to the wearer's finger.
Figure 2:
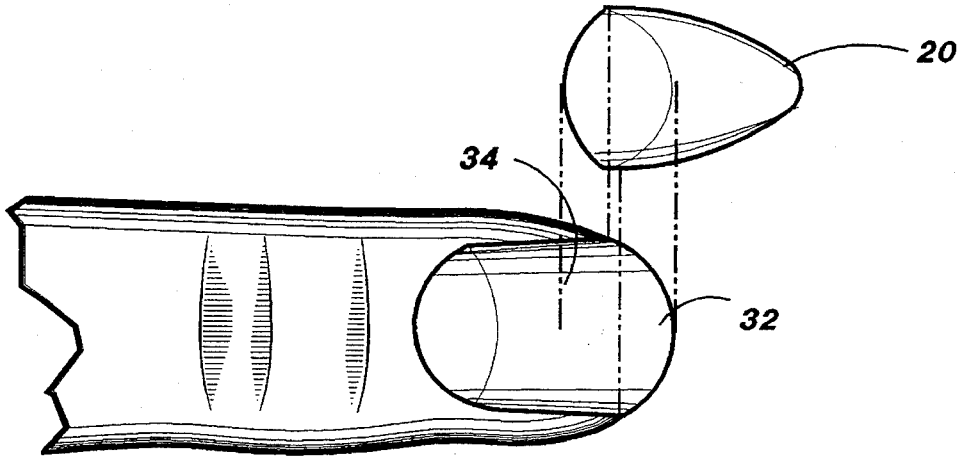
FIG. 2 (PRIOR ART)
FIG. 2 illustrates the placement of a non-cutaway nail of the prior art in relation to the wearer's finger.
Figure 3:
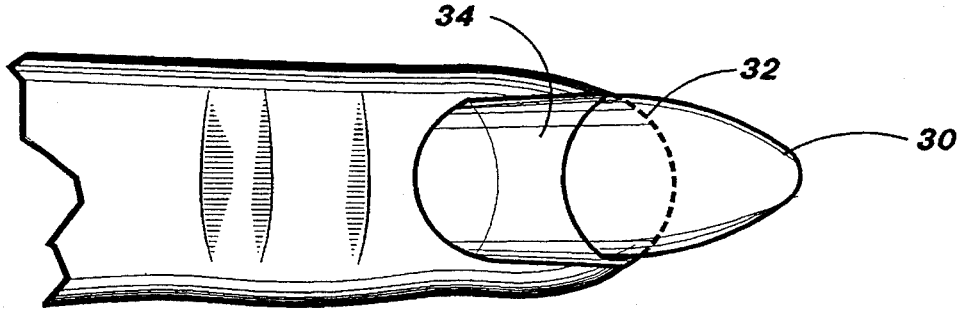
FIG. 3 (PRIOR ART)
FIG. 3 illustrates the placement of a non-cutaway nail of the prior art upon the wearer's fingernail.
Figure 4:
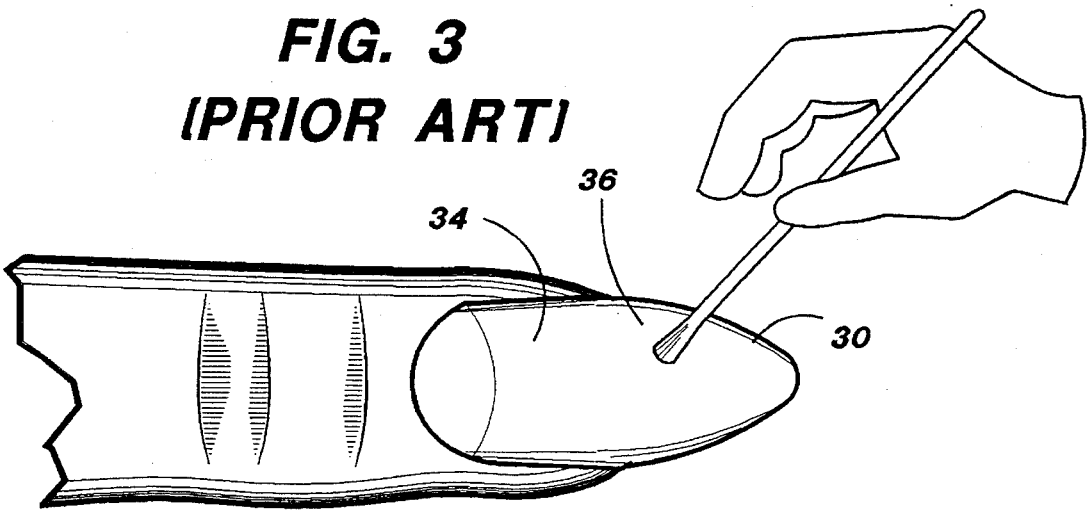
FIG. 4 (PRIOR ART)
FIG. 4 illustrates the protective coating of a non-cutaway nail of the prior art upon the wearer's fingernail.
Figure 5:
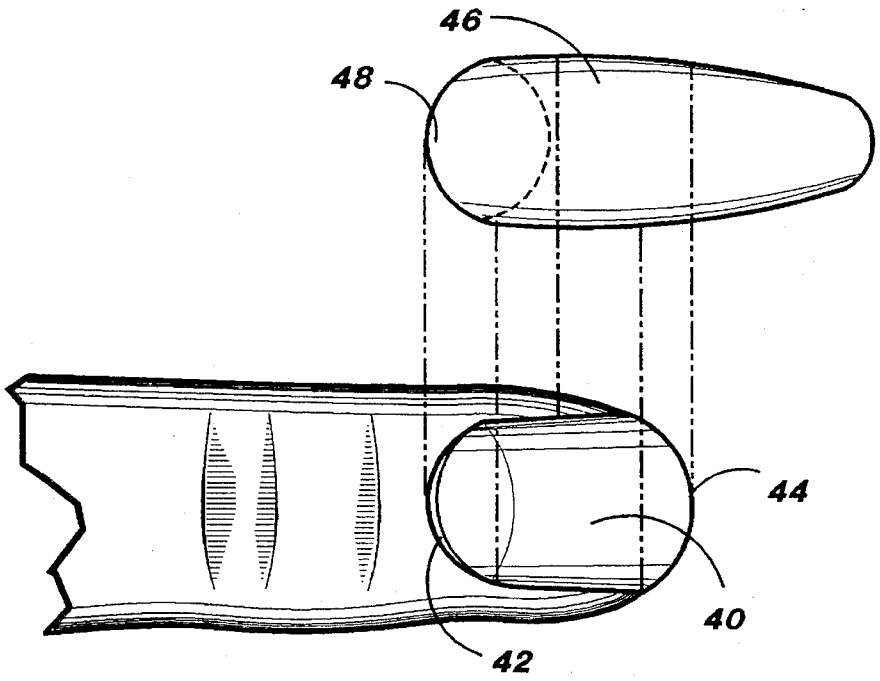
FIG. 5 illustrates the placement of the nail tip of the present invention in relation to the wearer's finger.
Figure 6:
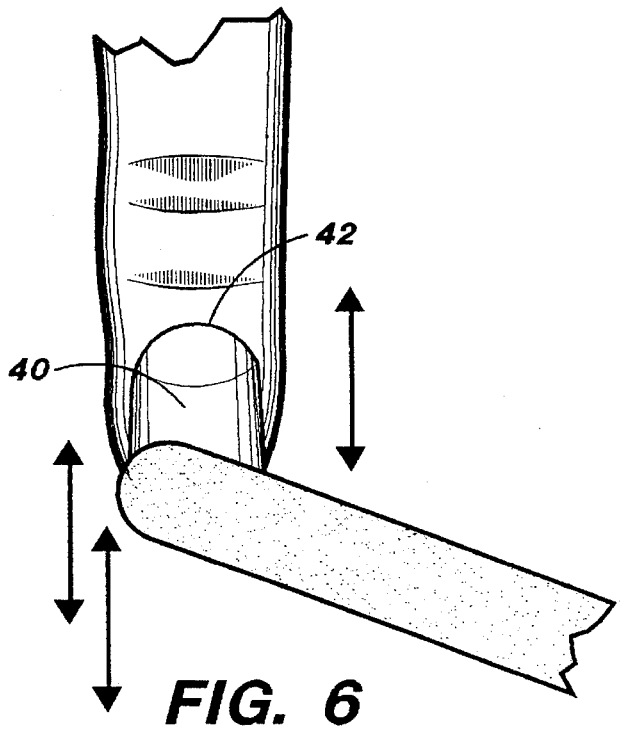
FIG. 6 illustrates the etching of the wearer's fingernail prior to the affixment of the nail tip to the fingernail.
Figure 7:
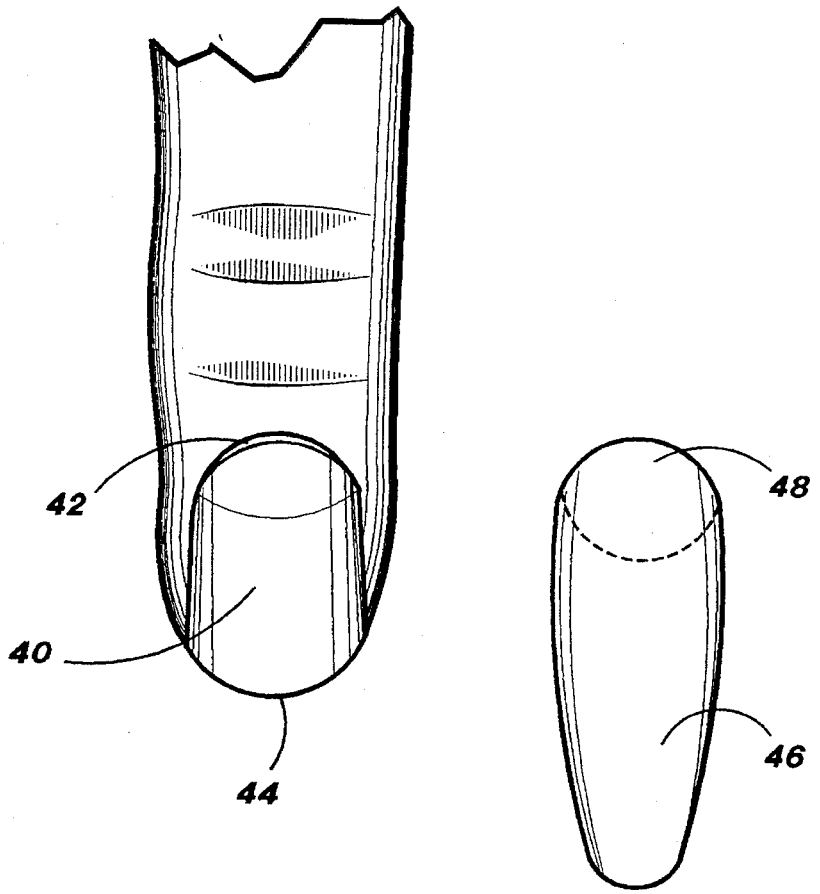
FIG. 7 illustrates the shaping of the cuticle end of the nail tip of the present invention to match the shape of the cuticle area of the wearer's fingernail.

Using a medium grit (100/180) nail file, the nail plate is etched in a vertical (from cuticle 42 to free edge 44) motion removing all surface oils and shine (FIG. 6). The goal of this step is to remove only the natural oils. Any dust created by the etching process is brushed away using a disinfected nail brush. A small amount of methacrylic acid primer is applied to each fingernail 40. The nails are then dried using a small hand held hairdryer set on low/warm until they appear white and chalky. Each natural nail is fitted with the proper sized non-cutaway nail tip 46. The cuticle end 48 of the non-cutaway nail tip 46 is reshaped to perfectly match the cuticle area 42 of the client's nails 40 (FIG. 7).

Figure 8:
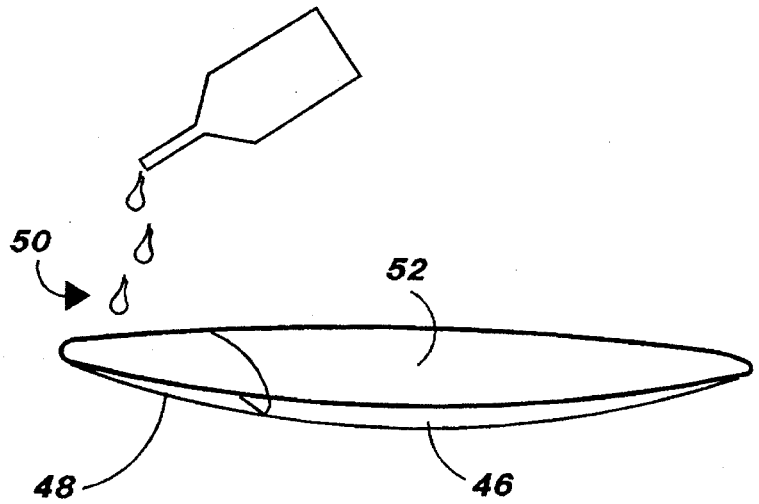
FIG. 8 illustrates the application of liquid nail glue to the underside contact area of the nail tip of the present invention.
Figure 9:
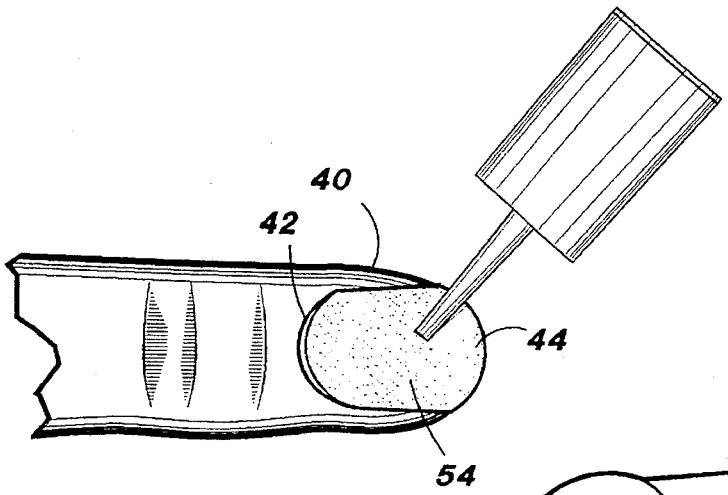
FIG. 9 illustrates the application of gelatinous nail glue to the wearer's fingernail.
Figure 10:
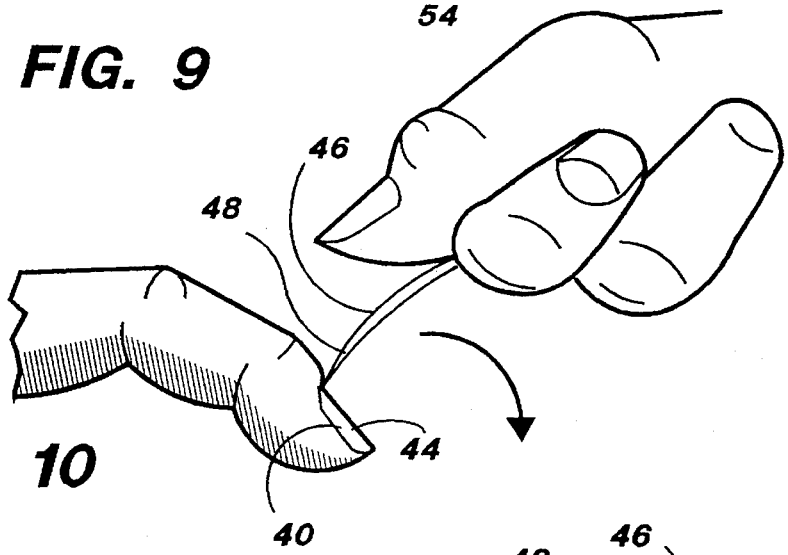
FIG. 10 illustrates the placement of the cuticle end of the nail tip on the cuticle area of the wearer's fingernail.
Figure 11:
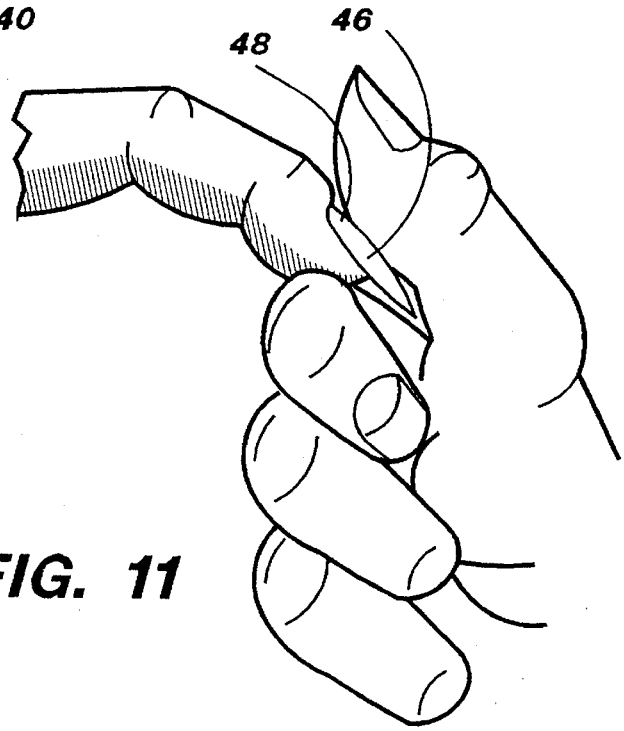
FIG. 11 illustrates the final placement of the nail tip on the wearer's fingernail.

A small amount of liquid nail glue 50 is placed on the underside contact area 52 of the non-cutaway nail tip 46 (FIG. 8), and a generous amount of gelatinous nail glue 54 is applied to the client's nail plate (FIG. 9). The non-cutaway nail tip is then held perpendicular the nail plate with the thin cuticle end touching the cuticle area of the natural nail. The non-cutaway nail tip is gently pivoted down, forcing the nail glue towards the free edge of the wearer's natural nail until parallel with the natural nail (FIG. 10). The non-cutaway nail tip is held in this position for several seconds allowing sufficient time for bonding to occur (FIG. 11). Excess gel is wiped away with a tissue or small cotton square using a rapid motion so as not to bond the tissue to the nail. Excess gel is wiped from underside of nail. Nail is then cut down to desired length and shaped using a file.

Cuticle oil or some type of mineral based oil is then applied to entire nail surface including the underside, exposed free edge of the extension. Wearer cleanses hands with disinfectant soap, brushing the top and underside of new extensions with a soapy nailbrush. After hands are rinsed and dried, polish can then be applied.

These nail tips are typically worn for approximately two weeks, more or less, depending on the client's individual rate of nail growth. At that time, the following procedure of maintenance and replacement is recommended: The old nails should be removed by soaking the fingers in a solution of acetone. As they soak, the nails will become soft and liquefied. The nail tips should be completely dissolved in about fifteen minutes. The nail technician should then inspect the client's natural nail for any signs of damage or infection. After all residual product is buffed off, and nails are certified to be healthy, a new set of nail tips may be applied according to the procedure above.

SUMMARY, RAMIFICATIONS, AND SCOPE

The present invention addresses many of the limitations which have plagued this aspect of the beauty industry for many years. It can be done in less time and at a lower cost than the prevailing methods. Furthermore, it has the additional advantages over prior methods in that

- its one-piece design eliminates chipping, cracking, and peeling.
- it is stronger and more durable than any other method available.
- a minimal amount of filing and shaping is required.
- relative to other similar services, it minimizes stress and damage to the natural nail.
- unlike other similar services, it can be successfully performed on severe nail biters.

The claims of superiority over prior art with respect to durability, ease of application, and cost have been amply confirmed in a commercial environment. Our salon offers expert service for every method of artificial nail application and the present invention is the method preferred by more than 80% of our clients.

Although the description above contains many specificities, these should not be construed as limiting the scope of the invention but as merely providing illustrations of some of the presently preferred embodiments of this invention. For example, to save even more time and effort, the non-cutaway nail tips could be manufactured in different colors, thus saving the step of polishing.

We claim:

1. A method for applying an artificial nail tip to a wearer's fingernail comprising the steps of:

a. selecting an artificial nail tip sized to fit over the wearer's fingernail, the nail tip having a cuticle end and an underside contact area;

b. shaping the cuticle end of the nail tip to conform to the cuticle area of the wearer's fingernail;

c. applying a small portion of regular liquid nail glue to the underside contact area of the nail tip;

d. applying a generous portion of gelatinous nail glue to the wearer's fingernail;

e. pressing the cuticle end of the nail tip against the cuticle of the wearer's fingernail;

f. pivoting the nail tip downward until the nail tip is seated over the fingernail; and g. applying pressure to the nail tip and allowing sufficient time for bonding of the nail tip to the fingernail.

2. The method of claim 1 wherein the nail tip has a thinned cuticle end.

3. The method of claim 1 preceded by the step of cleansing the wearer's finger.

4. The method of claim 1 further comprising the step of etching the wearer's fingernail prior to applying the gelatinous nail glue to the wearer's fingernail.

5. The method of claim 1 further comprising the step of applying primer to the wearer's fingernail prior to applying the gelatinous nail glue to the wearer's fingernail.

6. The method of claim 1 followed by the step of wiping away excess glue.

7. The method of claim 1 followed by the step of shaping the nail tip.

8. The method of claim 1 followed by the step of soaking the wearer's fingertip in a solvent until the nail tip is at least partially dissolved.

9. A method for applying an artificial nail tip to a wearer's fingernail comprising the steps of:

a. selecting an artificial nail tip sized to fit over the wearer's fingernail, the nail tip having a cuticle end and an underside contact area;

b. applying a generous portion of gelatinous nail glue to the wearer's fingernail;

c. pressing the cuticle end of the nail tip against the cuticle of the wearer's fingernail; and d. pivoting the nail tip downward until the nail tip is seated over the fingernail.

10. The method of claim 9 further comprising the step of applying a small portion of regular liquid nail glue to the underside contact area of the nail tip prior to seating the underside contact area of the nail tip atop the gelatinous nail glue.

11. The method of claim 9 further comprising the step of shaping the cuticle end of the nail tip to conform to the cuticle area of the wearer's fingernail prior to seating the underside contact area of the nail tip atop the gelatinous nail glue.

12. The method of claim 9 further comprising the step of etching the wearer's fingernail prior to applying the gelatinous nail glue to the wearer's fingernail.

13. The method of claim 9 further comprising the step of applying primer to the wearer's fingernail prior to applying the gelatinous nail glue to the wearer's fingernail.

14. The method of claim 9 followed by the step of shaping the nail tip.

15. The method of claim 9 followed by the step of soaking the wearer's fingertip in a solvent until the nail tip is at least partially dissolved.

16. The method of claim 15 wherein the step of soaking the wearer's fingertip in a solvent until the nail tip is at least partially dissolved is performed approximately two weeks after the nail tip is bonded to the wearer's fingernail.

17. The method of claim 9 preceded by the step of choosing the nail tip from several nail tips having a variety of colors.

18. A method for applying an artificial nail tip to a wearer's fingernail comprising the steps of:

a. selecting an artificial nail tip sized to fit over the wearer's fingernail, the nail tip having a thinned cuticle end and an underside contact area;

b. shaping the thinned cuticle end of the nail tip to conform to the cuticle area of the wearer's fingernail;

c. etching the wearer's fingernail;

d. applying a generous portion of gelatinous nail glue to the wearer's fingernail;

e. applying a small portion of regular liquid nail glue to the underside contact area of the nail tip;

f. pressing the thinned cuticle end of the nail tip against the cuticle of the wearer's fingernail;

g. pivoting the nail tip downward until the nail tip is seated over the fingernail;

h. applying pressure to the nail tip and allowing sufficient time for bonding of the nail tip to the fingernail; and i. shaping the nail tip.

19. The method of claim 18 further comprising the step of applying primer to the wearer's fingernail after etching the wearer's fingernail.

* * * * *